United States Patent [19]

Inaba

[11] Patent Number: 4,798,483

[45] Date of Patent: Jan. 17, 1989

[54] ELECTROTHERMAL PRINTING APPARATUS WITH ELECTRODES USABLE AS CURRENT SUPPLY OR RETURN

[75] Inventor: Katsuharu Inaba, Oume, Japan

[73] Assignee: Kabushiki Kaisha Toshiba, Kawasaki, Japan

[21] Appl. No.: 78,962

[22] Filed: Jul. 29, 1987

[30] Foreign Application Priority Data

Jul. 31, 1986 [JP] Japan ..... 61-178906

[51] Int. Cl.[4] ..... B41J 3/20

[52] U.S. Cl. ..... 400/120; 346/76 PH

[58] Field of Search ..... 400/120; 346/76 PH

[56] References Cited

U.S. PATENT DOCUMENTS

| | | | |
|---|---|---|---|
| 3,719,261 | 3/1973 | Heinzer et al. | 346/76 PH |
| 4,350,449 | 9/1982 | Countryman et al. | 400/120 |
| 4,484,200 | 11/1984 | Tabata et al. | 400/120 |
| 4,616,941 | 10/1986 | Nagai | 400/120 |
| 4,695,847 | 9/1987 | Ishii et al. | 400/120 |
| 4,704,616 | 11/1987 | Nakamura | 346/76 PH |

FOREIGN PATENT DOCUMENTS

| | | | |
|---|---|---|---|
| 87078 | 5/1983 | Japan | 400/120 |
| 78771 | 5/1985 | Japan | 400/120 |
| 78773 | 5/1985 | Japan | 400/120 |
| 172556 | 9/1985 | Japan | 400/120 |

*Primary Examiner*—David A. Wiecking

*Attorney, Agent, or Firm*—Foley & Lardner, Schwartz, Jeffery, Schwaab, Mack, Blumenthal & Evans

[57] ABSTRACT

In an electrothermal printing apparatus, conventionally, the printing head is provided with a plurality of printing electrodes and a single common return path forming element (GND) to selectively and locally heat ink on the ink ribbon. To reduce power loss due to the presence of the common return element, the novel printing apparatus eliminates the common return element and comprises in turn a plurality of first switching transistors for each supplying printing current to the ribbon via each printing electrode when activated and a plurality of second switching transistors for each returning the printing current from the ribbon via each printing electrode when activated. To heat the ribbon, printing current is selectively supplied to the ink ribbon via at least one first switching element connected to a printing electrode and returned via at least one second switching element connected to another printing electrode.

4 Claims, 4 Drawing Sheets

TO HEAT 3A:
( ONE DOT )

TO HEAT 3B,3D:
( TWO DOTS )

TO HEAT 3A,3C,3D
( THREE DOTS )

TO HEAT 3A,3B,3C,3D
( FOUR DOTS )
GND
CON.L.
12A
11A
YA
12B
11B
YB
12D
11D
YD
11C
YC
13B
13C
13D
I1
I2=I1/3
I2=I1
I2=2I1
I2
A
B
C
D

ELECTROTHERMAL PRINTING APPARATUS WITH ELECTRODES USABLE AS CURRENT SUPPLY OR RETURN

BACKGROUND OF THE INVENTION

1. Field of the Invention

The present invention relates to an electrothermal printing apparatus using an ink ribbon composed of three layers; a resistive, a conductive and an ink, layer. In printing apparatus of this type, when local points on the resistive layer are heated by passing current through a number of printing pin electrodes arranged on an end edge of a printing head brought into contact with the resistive layer, ink applied on the ink layer is melted by heat and therefore transferred to recording paper to form an image, such as a character.

2. Description of the Prior Art

In the prior art electrothermal printing apparatus, a common return path forming element is usually provided. In more detail, in FIG. 1, an ink ribbon 4 is made up of a resistive layer 1, a conductive layer 2, and an ink layer 3. A drive circuit is made up of printing electrodes (e.g. 40 dots) 5 and a common return path forming element 6 both contactable with the resistive layer 1, and a plurality of transistors 7 each connected to each printing electrode 5.

A plurality of the printing electrodes 5 are embedded within an insulating material in such a way that the tip ends of the electrodes 5 are vertically spaced equal distance apart and exposed from an end edge surface of the printing head. The ink layer 3 is thermally transferable ink material (e.g. heat fusable ink). The conductive layer 2 is aluminum. Each of the printing electrodes 5 is connected to each collector of each transistor 7, while the common return element 6 is grounded. A supply voltage (+V) is supplied to each emitter of each transistor 7, and a switching control circuit (not shown) is connected to bases of these transistors 7.

In operation, these transistors 7 are selectively turned on or off in response to control signals from the switching control circuit, for providing printing and non-printing operations. Upon turning-on of the transistor 7 and consequent energization of the corresponding printing electrode 5, current will flow from the electrode 5 via the resistive layer 1 and conductive layer 2 to the common return path forming element 6. When current flows through the resistive layer 1, power dissipated will cause heating of the resistive layer 1 extending from the tip end of the printing electrode 5 to the adjacent portion of the conductive layer 2. This localized heating of the resistive layer 1 by the electrical power dissipation will case melting of the thermally transferable material on the ink layer 3 and thereby form an image on a recording paper 8.

By concurrent energization of selected printing electrodes 5 during movement of the print head in a direction relative to the ink ribbon 4 and recording paper 8, a desired image (e.g. character) can be imprinted on the recording paper 8.

In the prior-art printing apparatus as described above, however, there exist a few drawbacks as follows:

(1) The common return path forming element 6 is readily heated by the common return current, thus increasing power loss therethrough and therefore deteriorating printing efficiency.

(2) The arrangement of the common return path forming element 6 in addition to the printing electrodes 5 inevitably increases the number of necessary parts, thus increasing the manufacturing cost thereof and decreasing the reliability thereof, because the element 6 is in slidable contact with the resistive layer 1.

(3When a great number of printing images are required to form by combining these printing electrodes 5, the presence of the common return path forming element 6 causes some restriction from design point of view.

The more detailed description of the above-mentioned prior-art printing apparatus is made in U.S. Pat. No. 4,350,449 by Countryman et al, thereby incorporated by reference herein.

SUMMARY OF THE INVENTION

With these problems in mind, therefore, it is the primary object of the present invention to provide an electrothermal printing apparatus which can eliminate the common return path forming element to decrease the power loss or increase the printing efficiency, and improve the reliability thereof.

To achieve the above-mentioned object, an electrothermal printing apparatus including an ink ribbon and a printing head provided with a plurality of printing electrodes for locally heating ink ribbon to transfer ink on the ribbon onto a recording paper when printing current is passed therethrough, according to the present invention, comprises a printing electrode driver having: (a) a plurality of first switching means each connected to a printing electrode, for supplying printing current to the ribbon when activated; (b) a plurality of second switching means each connected to a printing electrode, for returning the printing current from the ribbon when activated; and (c) printing current being selectively supplied to the ink ribbon via at least one first switching means connected to at least one printing electrode and returned from the ink ribbon via at least one second switching means connected to at least one the other printing electrode, to selectively heat ink ribbon at local ink areas adjoining to the printing electrodes through which printing current is supplied and returned.

In the apparatus according to the present invention, since the printing electrodes are used in common for the printing electrodes and the printing current returning electrodes (the common return path forming element), power loss caused through the return element can be eliminated; the number of parts can be reduced; and the printing electrodes can be arranged at higher density.

BRIEF DESCRIPTION OF THE DRAWINGS

The features and advantages of the electrothermal printing apparatus according to the present invention will be more clearly appreciated from the following description of the preferred embodiment taken in conjunction with the accompanying drawings in which like reference numerals designate the same or similar elements throughout the figure thereof and in which.

DETAILED DESCRIPTION OF THE PREFERRED EMBODIMENTS

Figure 1:
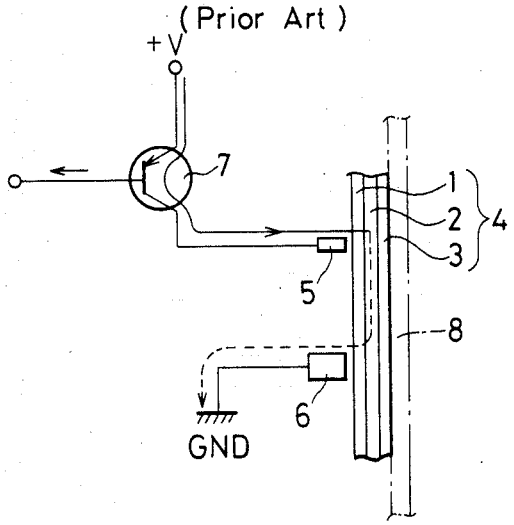
FIG.1 (Prior Art)
FIG. 1 is a diagram showing a driver circuit of a prior-art electrothermal printing apparatus.
Figure 2:
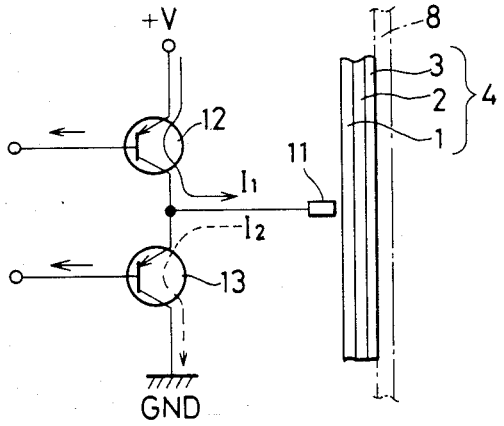
FIG. 2 is a diagram showing a driver circuit of an electrothermal printing apparatus of the present invention.

FIG. 2 shows a principle of an electrothermal printing apparatus of the present invention. In the same way as in the prior art apparatus shown in FIG. 1, an ink ribbon 4 is made up of a resistive layer 1, a conductive layer 2, and an ink layer 3, so as to be usable for the apparatus of the present invention. The printing apparatus of the present invention is characterized by a plurality electrodes 11, (only one electrode is shown in FIG. 2) a pair of current supply transistors 12 and a current return transistor 13, both connected to each printing electrode 11. The current supply transistor 12 supplies a printing current $I_1$ to the printing electrode 11; and the printing current $I_1$ is passed through the ink ribbon 4 (the resistive layer 1 and the conductive layer 2) and then returned to another current return transistor 13 also connected to another printing electrode 11.

Prior to the more detailed description of the printing apparatus, the positional and operational relationship between a printing head and the ink ribbon 4 will be explained with reference to FIG. 3. A recording paper 8 is first set to the outer periphery of a platen of the printing apparatus and rolled up appropriately. The ink ribbon 4 is supplied from a supply reel (not shown) to a take-up reel (not shown) being guided by three guide rollers, which are all mounted on a carriage. A pivotal head is arranged between two guide rollers as shown, in such a way as to be pivotable toward or away from the ink ribbon 4 about a head pin 20.

Figures 3, 3A:
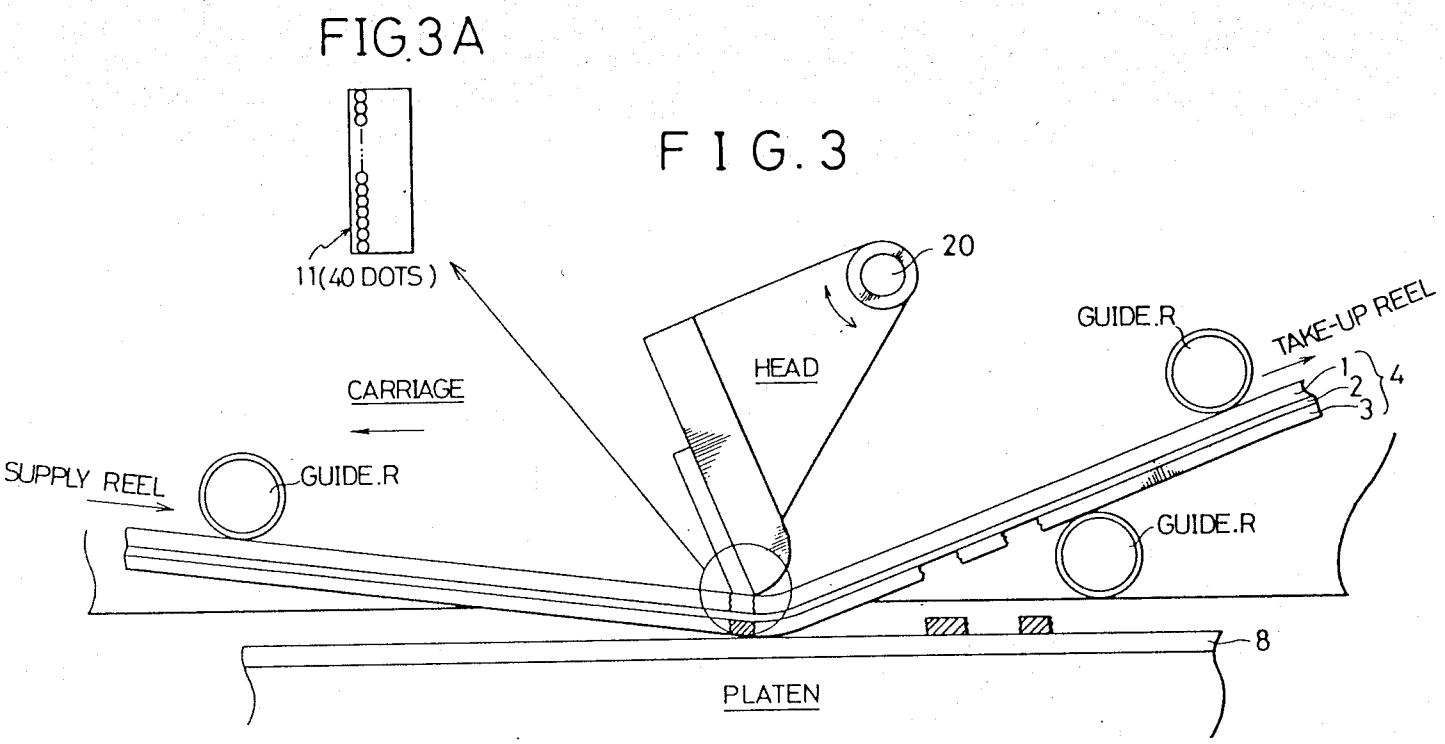
FIG. 3 is an enlarged diagrammatical illustration showing a printing head mounted on a carriage for assistance in explaining the principle of printing of the electrothermal printing apparatus.
FIG. 3A is an enlarged illustration showing a printing head end edge at which printing electrodes are arranged in a straight line.

The head is usually kept away from the recording paper 8, but urged toward the recording paper 8 in printing operationto such a position that a printing head end edge (at which a plurality of printing electrodes 11 (e.g. 40 dots) are arranged) brings the ink ribbon 4 into contact with the recording paper 8 on the platen, as depicted in FIG. 3. As shown in FIG. 3A, the printing electrodes 11 are arranged in a straight line being spaced equal distance apart and exposed from the outer surface of the printing head.

When printing current is passed through the printing electrode 11 in printing operation, the resistive layer 1 is heated and therefore heat fusable ink on the ink layer 3 is thermally transferred on the recording paper 8 locally to form an image on the recording paper 8. Concurrent energization of selected ones of the printing electrodes 11 during movement of the ink ribbon 4 relative to the printing head forms a desired image (e.g. character) on the recording paper 8.

With reference to FIG. 2 again, a printing electrode 11 is connected to a current supply transistor 12 and a current return transistor 13. In more detail, the collector of the transistor 12 is connected to the emitter of the transistor 13; the printing electrode 11 is connected to a junction point between the two. The emitter of the transistor 12 is connected to a supply voltage +V, while the collector of the transistor 13 is grounded. The bases of these two transistors 12 and 13 are connected to a controller (not shown) for outputting control signals to selectively turn the transistors 12 and 13 on or off.

In the above configuration, when the transistor 12 is turned on and the transistor 13 is turned off, printing current $I_1$ flows from the supply voltage (+V) to the ground by way of the current supply transistor 12, the printing electrode 11, the ink ribbon 4 (the resistive layer 1, the conductive layer 2), another printing electrode 11 and another current return transistor 13 connected to another printing electrode. Therefore, the resistive layer 1 in contact with the printing electrode 11 is heated locally, so that ink on the ink layer 3 is melted and transferred onto the recording paper 8. The above condition of the printing electrode 11 is referred to as a supply state "H", hereinafter.

When the transistor 12 is turned off and the transistor 13 is turned on, return current $I_2$ supplied through another printing electrode 11 and flowing through the ink ribbon 4 is returned to the ground GND via the transistor 13. The above condition of the electrode 11 is referred to as a return state "L", hereinafter.

When the two transistors 12 and 13 are both turned off, no current flows through the printing electrode 11. The above condition of the electrode 11 is referred to as a high impedance state "Z", hereinafter.

As described above, the two transistors 12 and 13 connected to each printing electrode 11 as a driver are selectively switched into three states; , current supply "H", current return "L" and high impedance "Z", in resonse to control signals applied from the controller (not shown).

Therefore, it is possible to obtain any desired image or pattern on the recording paper 8 by controlling a number of pairs of these two transistors 12 and 13 connected to each of printing electrodes 11 arranged at the head end edge and by moving the ink ribbon 4 relative to the printing head, while moving the carriage to the recording paper 8.

Figure 4:
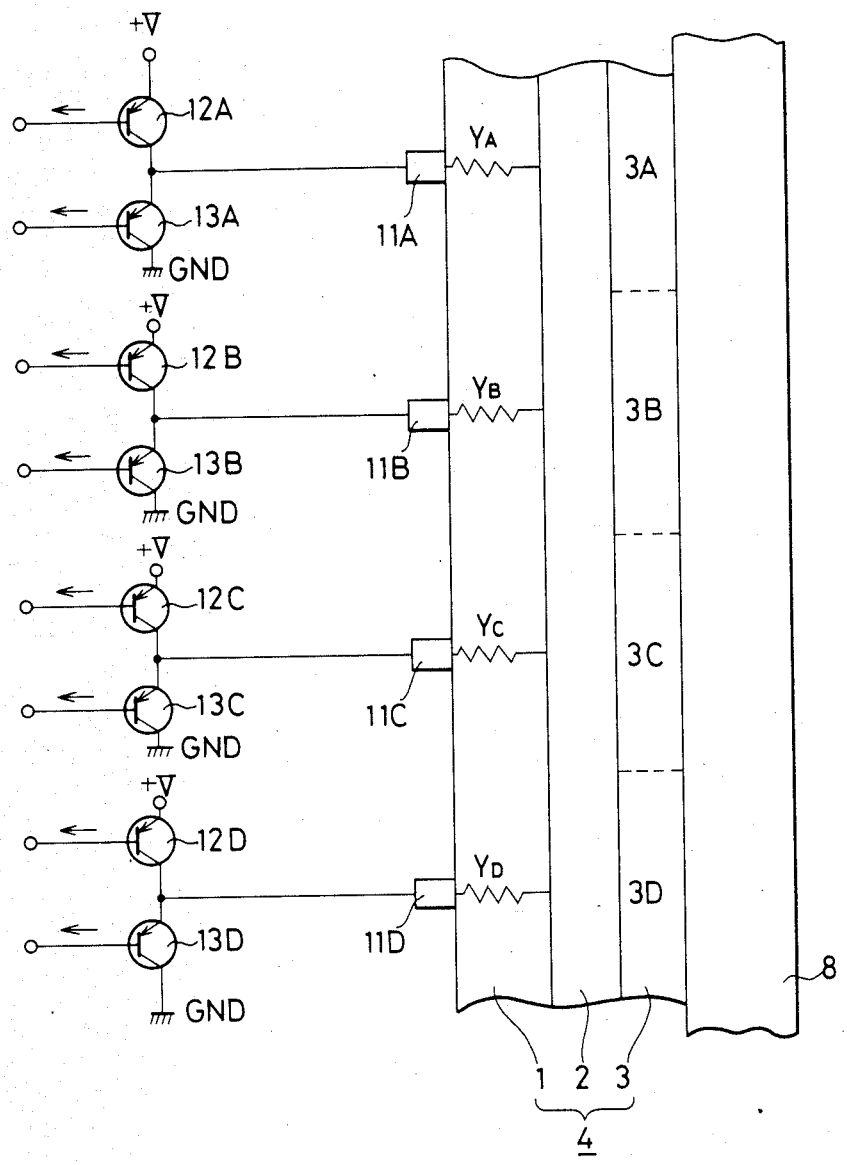
FIG. 4 is an exemplary driver circuit diagram of a four-electrode printing apparatus of the present invention.
Figures 5A, 5B, 5C, 5D:
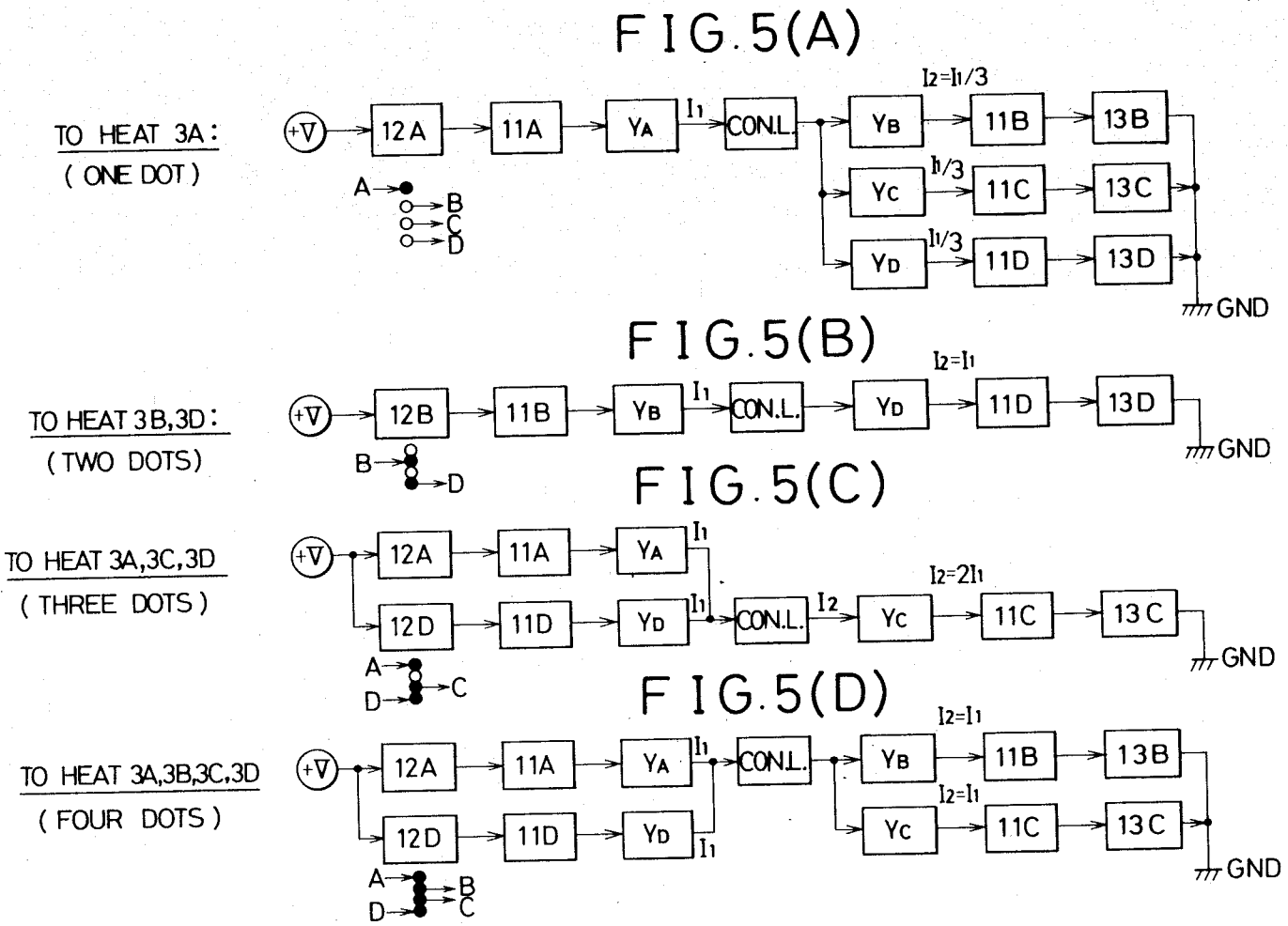
FIGS. 5(A), (B), (C) and (D) are block diagrams for assistance in explaining exemplary current paths of the driver circuit shown in FIG. 4.

FIG. 4 is a connection diagram including four pairs of these two transistors 12A and 13A, 12B and 13B, 12C and 13C and 12D and 12D connected to these printing electrodes 11A, 11B, 11C and 11D, respectively, by way of example. In the drawing, the numerals 3A, 3B, 3C and 3D divided in the ink layer 3 denote areas subjected to the heating influence of the printing electrodes 11A, 11B, 11C and 11D, respectively. Ink in any required areas 3A, 3B, 3C and 3D can be transferred onto the recording paper 8 by selectively driving a plurality of printing electrodes in combination.

Exemplary operations of transferring ink on the ink ribbon 4 onto the recording paper 8 will be described in further detail with reference to FIGS. 5(A) to (D).

(1) When ink in area 3A is transferred (one dot heating) (FIG. 5A):

The controller turns on the current supply transistor 12A and the current return transistors 13B, 13C and 13D and turns off the current supply transistors 12B, 12C and 13D and the current return transistor 13A. Therefore, the printing electrode 11A is in state "H", the electrodes 11B, 11C and 11D are in state "L". Therefore, printing current flows from the supply voltage +V to the ground GND by way of the transistor 12A, the printing electrode 11A, a resistive layer $Y_A$, a conductive layer 2, and three parallel-connected return circuits each composed of a resistive layer $Y_B$, $Y_C$ or $Y_D$, a printing electrode 11B, 11C or 11D and a current return transistor 13B, 13C or 13D, respectively.

Here, it should be noted that the return current is divided into three parallel circuits. In other words, since printing current $I_1$ is passed through the printing electrode 11A, the resistive layer $Y_A$ in contact with the electrode 11A is heated high to such an extent as to melt ink on the ink area 3A for ink transferring. However, since return current $I_2$ is divided into three paths ($I_2 = I_1/3$,) the resistive layer $Y_B$, $Y_C$ and $Y_D$ in contact with the electrodes 11B, 11C and 11D are heated low (about 1/9) to such an extent as not to melt ink on the ink areas 3B, 3C and 3D. Therefore, only the ink area 3A is heated and only ink therein is transferred to print only one dot (A).

(2) When ink in areas 3B and 3D is transferred (two dot heating) (FIG. 5B):

The controller turns on the current supply transistor 12B and the current return transistor 13D and turns off all the other transistors 12A, 12C and 12D and 13A, 13B and 13C.

Therefore, the printing electrode 11B is in state "H"; the printing electrode 11D is in state "L"; and the other electrodes 11A and 11C are in state "Z". Therefore, the printing current $I_1$ flows from the supply voltage $+V$ to the ground GND by way of the transistor 12B; the printing electrode 11B, the resistive layer $Y_B$, the conductived layer 2, the resistive layer $Y_D$, the printing electrode 11D, and the return transistor 13D.

In this case, since the return current $I_2$ is the same as the printing current $I_1$, the resistive layers $Y_B$ and $Y_D$ in contact with the electrodes 11B and 11D are heated simultaneously high enough to melt ink in the areas 3B and 3D, so that two dots (B, D) are printed.

(3) When ink in areas 3A, 3C and 3D is transferred (three dot heating) (FIG. 5C):

The controller turns on the current supply transistors 12A and 12D and the current return transistor 12C and turns off the other transistor 12B and 12C and 13A, 13B and 13D. That is, the printing electrodes 11A and 11D are in state "H", the printing electrode 11C is in state "L"; and the printing electrode 11B is in states "Z". Therefore, the printing current $I_1$ flows in parallel through the printing electrode 11A and 11D, and a return current $I_2 = 2I_1$ flows through the printing electrode 11C to simultaneously heat ink on the areas 3A, 3C and 3D. In this case, since the area 3C is sufficiently heated by a return current twice larger than the supply current, and three dots (A, C and D) are printed.

(4) When ink in areas 3A, 3B, 3C and 3D is transferred (four dot heating) (FIG. 5D):

The controller turns on the current supply transistors 12A and 12D and the current return transistors 13B and 13C and turns off the other transistors 12B and 12C and the current return transistors 13A and 13D.

That is, the printing electrodes 11A and 11D are in state "H", and the printing electrodes 11B and 11C are in state "L". Therefore, the printing current $I_1$ flows in parallel through the printing electrode 11A and 11D, and a return current $I_2 = I_1$ flow in parallel through the printing electrode 11B and 11C to simultaneously heat ink on all the areas 3A, 3B, 3C and 3D, thus four dots (A, B, C and D) being printed.

As described, in the printing apparatus of the present invention, a plurality of printing electrodes 11 are arranged in a straight line on the end edge of the printing head; and each of the printing electrode 11 is connected to a pair of current supply and return transistors 12 and 13; the ink ribbon is fed horizontally relative to the head; and the carriage on which the head and ink ribbon are mounted is moved relative to the recording paper. Therefore, it is possible to form various images on the recording paper by selectively driving the transistors in three, supply, return and high impedance, states in order to selectively heat ink on the ink ribbon.

In the above description with reference to FIGS. 5(A) to (D), the operation of the apparatus according to the present invention has been explained only by way of example, where four printing electrodes are arranged. Therefore, where 40 printing electrodes are arranged, for instance, it is possible to divide the return current $I_2$ into four or more return transistors; or to drive the three or more current supply and return transistors simultaneously.

The selection of these supply and return transistors will not be limited by the number of dots or images required to be formed on the recording paper.

In the present invention, since the printing electrodes can be used in common as the return electrodes, the power consumption can be reduced; the printing efficiency can be improved; the printing electrodes can be arranged at high density; and the reliability can be increased, while reducing the manufacturing cost.

What is claimed is:

1. In an electrothermal printing apparatus including an ink ribbon having a resistive layer, a conductive layer and an ink layer and a printing head provided with a plurality of printing electrodes for locally heating the ink layer to transfer ink from the ribbon to a recording paper when printing current is passed through the printing electrodes, printing electrode driver means comprising:

(a) a plurality of first switching means each connected to each printing electrode, for supplying printing current to the ribbon when activated;

(b) a plurality of second switching means each connected to each printing electrode, for returning the printing current from the ribbon when activated; and (c) means for supplying a printing current to the ink ribbon via at least one first switching means connected to at least one printing electrode and for returning from the ink ribbon via at least one second switching means connected to at least one other printing electrode, to selectively heat the ink ribbon at ink areas adjoining to the printing electrodes through which the printing current is supplied or returned.

2. The electrothermal printing apparatus as set forth in claim 1, wherein the printing current is supplied to the ink ribbon via at least one first switching means connected to at least one printing electrode and returned from the ink ribbon via at least two second switching means connected to at least two of the other printing electrodes, to heat ink ribbon only at an ink area adjoining at least one printing electrode.

3. The electrothermal printing apparatus as set forth in claim 1, wherein the printing current is supplied to the ink ribbon via at least two first switching means connected to at least two printing electrodes and returned from the ink ribbon via at least one second switching means connected to at least one other printing electrode, to heat ink ribbon at ink areas adjoining to the two and the other printing electrodes.

4. An electrothermal printing apparatus comprising:

an ink ribbon having an electrically conductive layer and an ink transferring layer;

a plurality of aligned printing electrodes, said electrodes in resistive electrical contact with said ribbon;

a pair of electrical switching means for each said printing electrode, one switching means of each said pair of switching means supplying current to said electrode, the other switching means grounding current from said electrode; and control means for selectively operating such said electrical switching means, whereby current is supplied by one or more supplying electrodes to a particular region on said ribbon which is to effect printing and returned to ground through one or more said grounding electrodes.

* * * * *